US005454369A

United States Patent [19]

Müller et al.

[11] Patent Number: 5,454,369

[45] Date of Patent: Oct. 3, 1995

[54] BREATHING MASK WITH FIXED MASK BODY

[75] Inventors: Rüdiger Müller; Thomas Neuber; Manfred Gdulla, all of Lübeck, Germany

[73] Assignee: Drägerwerk AG, Lübeck, Germany

[21] Appl. No.: 157,933

[22] Filed: Nov. 24, 1993

[30] Foreign Application Priority Data

Dec. 3, 1992 [DE] Germany ..... 42 40 626.9

[51] Int. Cl.[6] ..... A62B 18/08

[52] U.S. Cl. ..... 128/206.24; 128/206.21

[58] Field of Search ..... 128/863, 206.24, 128/206.21

[56] References Cited

U.S. PATENT DOCUMENTS

| | | | |
|---|---|---|---|
| 596,919 | 1/1898 | Steves | 128/206.24 |
| 1,096,761 | 5/1914 | Scheer | 128/206.24 |
| 1,127,122 | 9/1915 | Furtaw | 128/206.24 |
| 1,362,766 | 12/1920 | McGargill | 128/206.24 |
| 1,975,797 | 10/1934 | Montuori | 128/206.24 |
| 2,036,850 | 4/1936 | Bullard | 128/206.24 |
| 3,181,531 | 5/1965 | Angioletti | 128/206.24 |
| 4,296,746 | 10/1981 | Mason, Jr. et al. | 128/206.24 |
| 4,657,010 | 4/1987 | Wright | 128/206.24 |
| 4,764,990 | 8/1988 | Markert | 128/206.24 |
| 4,881,538 | 11/1989 | Angell | 128/206.24 |

FOREIGN PATENT DOCUMENTS

| | | |
|---|---|---|
| 2329668 | 1/1975 | Germany . |
| 0304641 | 3/1989 | Germany . |

*Primary Examiner*—Edgar S. Burr
*Assistant Examiner*—Aaron J. Lewis
*Attorney, Agent, or Firm*—McGlew and Tuttle

[57] ABSTRACT

A breathing mask with a fixed, curved mask body and with a mask edge extending around the mask body and adapted to the shape of the face for attaching a sealing edge sealing the mask body against the face and with a supply opening located in the mouth area of the mask body. The mask body provides low-distortion vision along with the largest possible useful field of vision. To accomplish this task, the curvature in azimuthal section planes (5, 6, 7) of the mask body (1) is designed to decrease continuously in the corresponding section plane toward the mask edge (2), starting from a meridian symmetry axis (4) of the mask body; that the azimuthal curvature on the meridian symmetry axis (4) also decreases monotonically, starting from the mouth area (8); and that the meridian curvature of the mask body 1 along the symmetry axis (4) is essentially uniform.

5 Claims, 3 Drawing Sheets

BREATHING MASK WITH FIXED MASK BODY

FIELD OF THE INVENTION

The present invention pertains to a breathing mask with a fixed, curved mask body and with a mask edge extending around the mask body and adapted to the shape of the face of a mask user for fastening a sealing edge sealing the mask body against the face, and with a supply opening located in the mouth area of the mask body.

BACKGROUND OF THE INVENTION

A breathing mask of the type mentioned above has become known from EP-A 304 641. The prior-art breathing mask has a fixed mask body made of a transparent material, with a circumferential mask edge delimiting the mask body, to which mask edge a flexible sealing edge is attached. The flexible sealing edge comes into contact with the face of a mask user.

The mask body itself is designed as a curved mask body in both the meridian direction and the circumferential direction and has a flat surface, which is used as a sight opening for the mask user, in the area of the eyes. A supply opening for consumable liquid is located in the mouth area of the mask body.

It is disadvantageous in the prior-art breathing mask that the mask user has low-distortion vision only within the flat surface of the mask body, as a result of which the useful facial field is limited to this area.

It is also disadvantages in terms of vision that cushion-like distortions of the image may occur as the angle of vision through the flat surface becomes increasingly oblique.

A breathing mask with a breathing filter has become known from DE-A- 23 29 668; this breathing mask has a mask body made of a transparent plastic, which is in contact with the mask user's face along a sealing line extending over the forehead, the cheeks, and the chin. The mask body is curved in both the meridian and horizontal directions. Since the mask body fits the contours of the face when the breathing mask is put on, undefined curvatures may develop, which may lead to distortion of the image, at least at certain angles of vision. Such distortion can be disturbing by the mask user and reduces the suitability of the breathing mask for use.

SUMMARY AND OBJECTS OF THE INVENTION

The basic object of the present invention is to in, prove a breathing mask such that the mask body permits low-distortion vision through the transparent part of the mask body at the largest possible useful facial field and has a small dead space.

This object is attained by the curvature being continuously reduced toward the mask edge in azimuthal section planes of the mask body, in the corresponding section plane, starting from a meridian symmetry axis of the mask body, by the azimuthal curvature on the meridian symmetry axis likewise monotonically decreasing starting from the mouth area, and by the meridian curvature of the mask body being essentially uniform along the symmetry axis.

The advantage of the present invention is essentially the fact that due to the continuously changing azimuthal curvature of the mask body in fixed horizontal section planes of the mask body, on the one hand, and along the meridian symmetry axis, on the other hand, a low-distortion field of vision is obtained, which is present even in the case of oblique directions of vision. Due to the shaping of the mask body according to the present invention, practically the entire transparent part of the mask body can be used as a visual surface. Due to the meridian curvature along the symmetry axis, particularly good adaptation of the mask body to the contour of the mask user's face with the smallest possible dead space is achieved. The curvature according to the present invention is related to the areas of the mask body located in the mask user's field of vision. Deviations may also occur in areas of secondary importance of the mask body, e.g., at the supply opening or in the vicinity of the mask edge.

The radii of azimuthal curvature along the meridian symmetry axis are preferably designed such that they increase from about 40 mm to about 90 mm starting from the mouthpiece. Relative to the azimuthal section planes, whose curvature continuously decreases starting from the meridian symmetry axis, this means that the radii of azimuthal curvature are minimal on the symmetry axis, i.e., the symmetry axis represents an optical center of the mask body.

The radii of curvature indicated define a preferable order of magnitude for the range of values, which must be adjusted by the person skilled in the art to the boundary conditions of the mask body, e.g., the contours of the mask edge.

A favorable dead space is obtained for the mask body when the radius of curvature of a meridian section plane of the mask body extending along the symmetry axis is greater than 80 min. The dead space decreases with increasing radius of curvature. R=200 mm is a particularly favorable radius of curvature.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
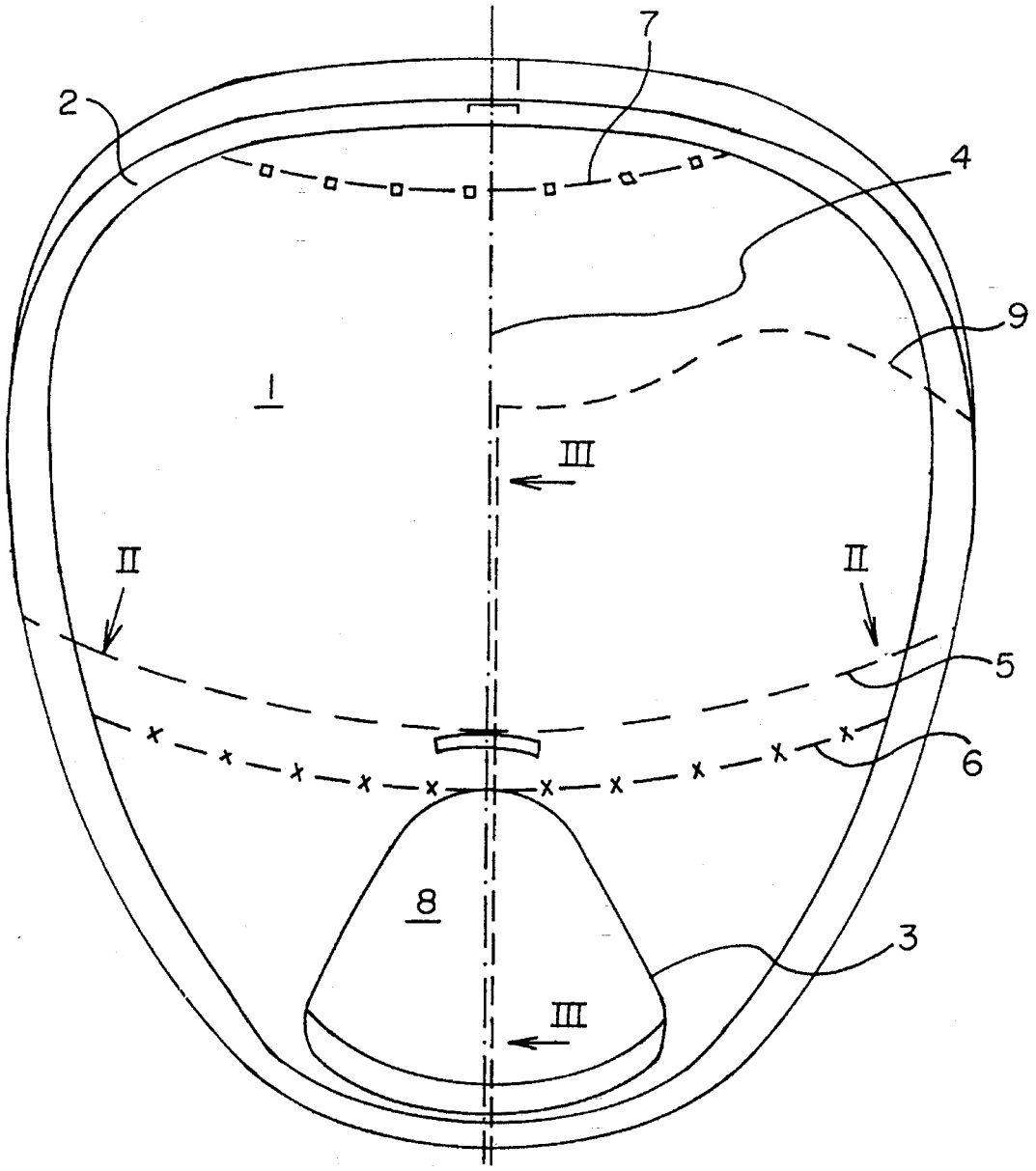
FIG. 1 is a front view of a mask body.

FIG. 1 shows a front view of a mask body 1 of a breathing mask (not shown in the figure) with circumferential mask edge 2 adapted to the face of a mask user likewise (not shown in FIG. 1 ) and with a supply opening 3 for respiration gas in the mouth area 8. The mask body 1 is a fixed structure, the curvature is fixed (rigid), and is transparent, designed symmetrically along a symmetry axis 4 extending in the meridian direction and has a bulge, which projects from the plane of the drawing and is illustrated by a first azimuthal section plane 5 shown in dotted line. A second azimuthal section plane 6 and a third azimuthal section plane 7, which are located in parallel to one another as horizontally extending section planes, are indicated as additional azimuthal section planes. The curvatures of the individual azimuthal section planes 5, 6, 7 are selected to be such that they continuously decrease starting from the symmetry axis 4 toward the mask edge 2, i.e., the radii of curvature increase toward the mask edge 2, i.e., the bulge becomes flatter. The azimuthal section planes 5, 6, 7 represent a plurality of azimuthal section planes, all of which are located horizontally in relation to one another, and their curvature changes such that the curvature continuously decreases from the symmetry axis 4 toward the mask edge 2. The symmetry axis extending in the meridian direction, acting as a geometric locus of the maximum curvature of the respective azimuthal section planes 5, 6, 7, is an optical center of the mask body 1. The curvature of the section planes 5, 6, 7 also decreases monotonically from the mouth area 8 in relation to the point of intersection with the symmetry axis 4. For example, the radius of curvature is approximately 40 mm at the point of intersection between the second azimuthal section plane 6 and the symmetry axis 4, and the radius of curvature is 90 mm at the corresponding point of intersection of the third azimuthal section plane 7. The point of intersection of the symmetry axis 4 with the section planes 5, 6, 7 is defined as the point of intersection of the vertical projection of the symmetry axis 4 on the mask body 1 with the section planes 5, 6, 7.

Figure 2:
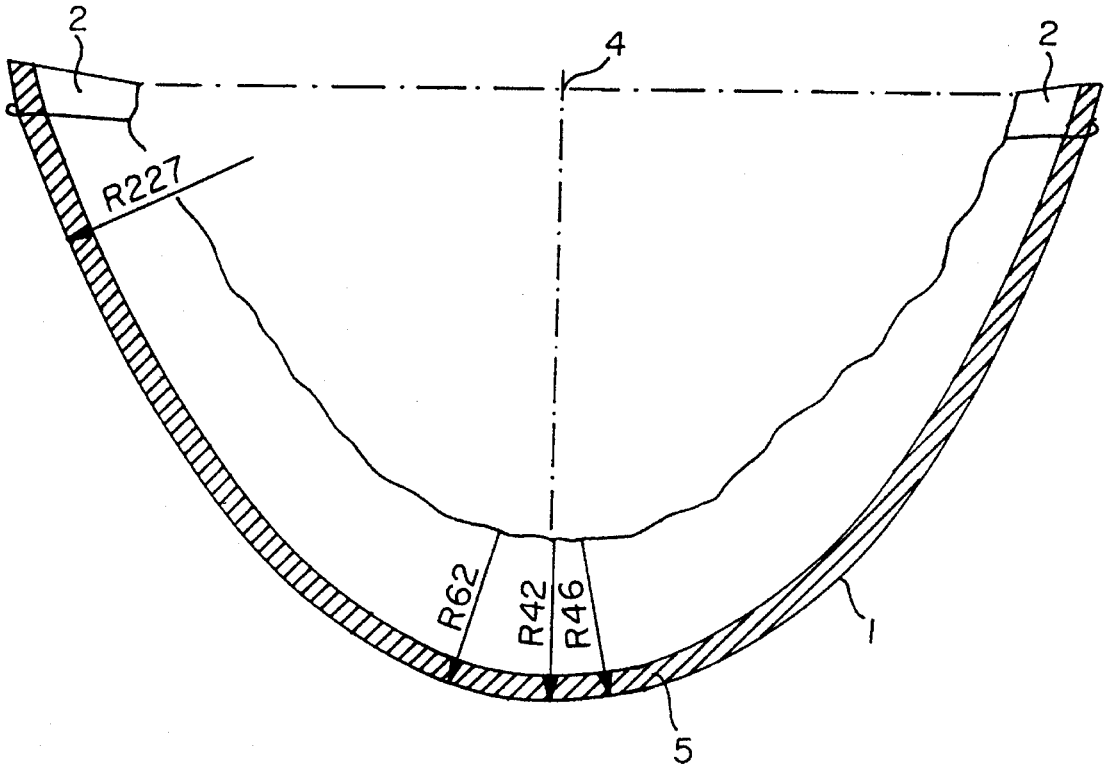
FIG. 2 is a sectional view along line II—II of the mask body according to FIG. 1.

FIG. 2 shows the sectional view II—II of the mask body 1 according to FIG. 1, with view to the first azimuthal section plane 5.

Identical components are designated by the same reference numerals as in FIG. 1. As is apparent from the radii of curvature shown in the drawing, the radius of curvature is smallest with R=42 mm at the point of intersection with the projection of the symmetry axis 4 and greatest at the transition to the mask edge 2.

Figure 3:
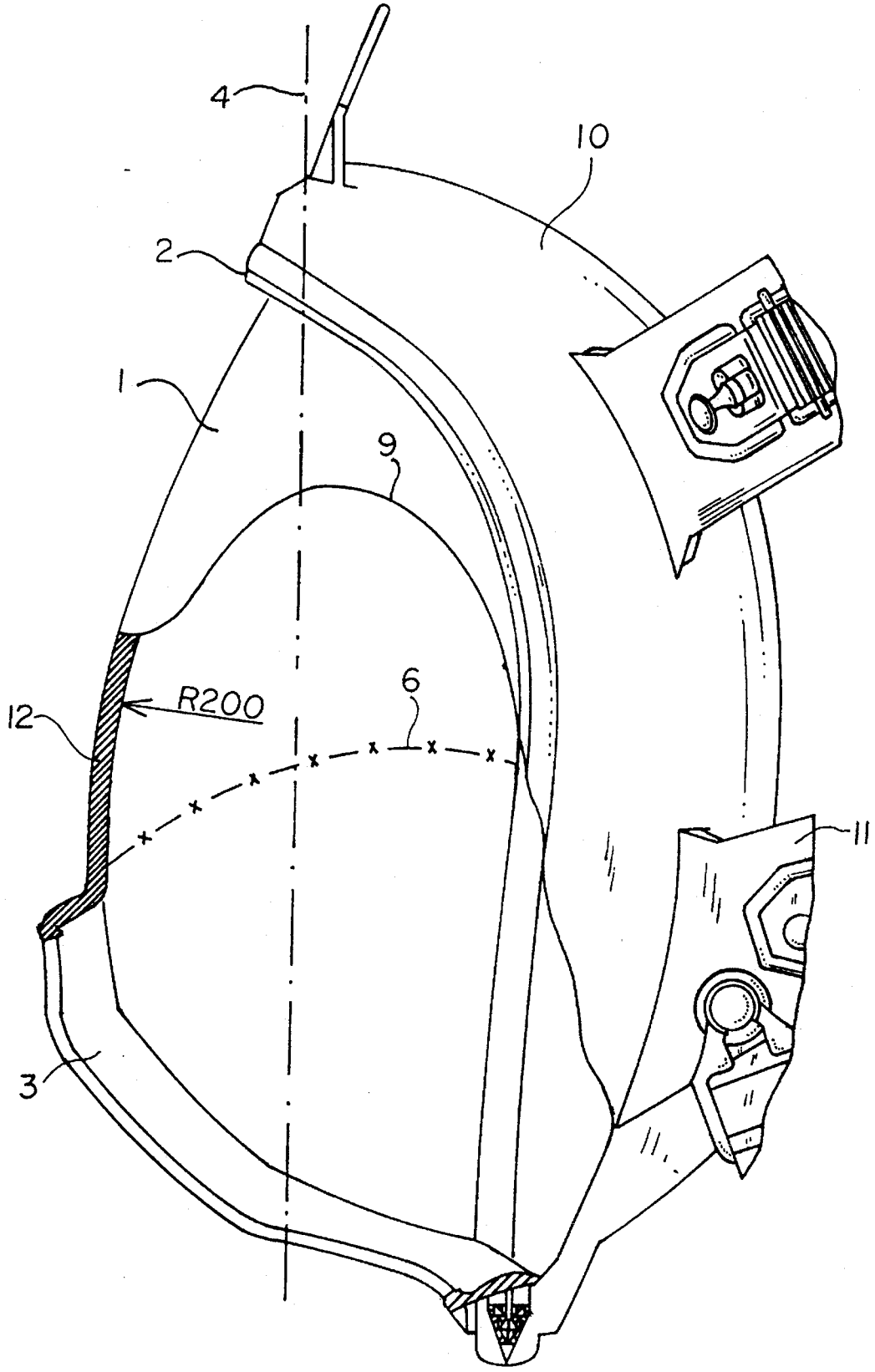
FIG. 3 is a longitudinal section along line III—III of the mask body according to FIG. 1.

FIG. 3 shows a longitudinal section of the mask body 1 along the section line 9, with the direction of vision III—III according to FIG. 1. The difference from FIGS. 1 and 2 is that a sealing edge 10 with a strap 11 is additionally arranged at the mask edge 2. Identical components are designated by the same reference numerals as in FIGS. 1 and 2. The meridian section plane 12 extending along the symmetry axis 4 has a constant radius of curvature of R=200 mm in order to ensure good adaptation of the mask body 1 to the mask user's face, which leads to a small dead space inside the mask body 1.

While a specific embodiment of the invention has been shown and described in detail to illustrate the application of the principles of the invention, it will be understood that the invention may be embodied otherwise without departing from such principles.

What is claimed is:

1. Breathing mask comprising:

a curved mask body of a fixed shape and having at least one transparent portion, and a mask edge extending around said mask body and adapted to a shape of a face of a user for attaching a sealing edge sealing the mask body against the face and with a supply opening located in a mouth area of the mask body, said mask body having a meridian symmetry axis and a curvature in azimuthal section planes which decreases continuously in each corresponding section plane starting from said meridian symmetry axis of said mask body toward said mask edge, said meridian symmetry axis providing a geometric locus of a maximum curvature of each corresponding section plane, said mask body having an azimuthal curvature on the meridian symmetry axis which decreases monotonically starting from a mouth area and said mask body having a meridian curvature along said meridian symmetry axis, said meridian curvature being substantially uniform.

2. Breathing mask in accordance with claim 1 wherein:

a radii of azimuthal curvature along the meridian symmetry axis increase from about 40 mm to about 90 mm, starting from said mouth area.

3. Breathing mask in accordance with claim 2 wherein:

a radius of curvature of a meridian section plane of the mask body extending along said symmetry axis is greater than 80 mm.

4. Breathing mask in accordance with claim 1 wherein:

a radius of curvature of a meridian section plane of the mask body extending along said symmetry axis is greater than 80 mm.

5. A breathing mask comprising:

a curved mask body of a fixed shape and having at least one transparent portion, said masked body having a meridian symmetry axis and having a curvature in three azimuthal section planes which curvature decreases continuously in each corresponding section plane starting from said meridian symmetry axis of said mask body toward an edge of said mask body, said meridian symmetry axis providing a geometric locus of maximum curvature of each corresponding section plane, said meridian symmetry axis having an azimuthal curvature which is greatest at a lower most of said three azimuthal section planes and which is least at an uppermost one of said three azimuthal section planes, said mask body having a meridian curvature said meridian symmetry axis which is substantially uniform, said masked body having a supply opening located in a mouth area of the mask body; and a mask edge extending around said masked body and adapted to a shape of a face of a user for attaching a sealing edge sealing the masked body against the face of a user.

* * * * *